US007397339B2

(12) United States Patent
Berg et al.

(10) Patent No.: US 7,397,339 B2
(45) Date of Patent: Jul. 8, 2008

(54) METHOD FOR AMBIENT TEMPERATURE COMPENSATING THERMOSTAT METAL ACTUATED ELECTRICAL DEVICES HAVING A PLURALITY OF CURRENT RATINGS

(75) Inventors: Peter G. Berg, North Attleboro, MA (US); Jacky C. Chan, Framingham, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 367 days.

(21) Appl. No.: 11/250,646

(22) Filed: Oct. 14, 2005

(65) Prior Publication Data

US 2007/0085651 A1 Apr. 19, 2007

(51) Int. Cl.
*H01H 71/16* (2006.01)
*H01H 33/30* (2006.01)
*H01H 9/30* (2006.01)

(52) U.S. Cl. ..... 337/99; 337/101; 337/67; 337/82; 337/378

(58) Field of Classification Search ..... 337/67, 337/82, 85, 94, 101, 360, 368, 378, 99; 29/622
See application file for complete search history.

(56) References Cited

U.S. PATENT DOCUMENTS

| | | | | | |
|---|---|---|---|---|---|
| 1,895,590 | A * | 1/1933 | Spencer | 337/379 |
| 3,361,882 | A | 1/1968 | Clarke | |
| 3,697,615 | A * | 10/1972 | Brassard | 337/74 |
| 3,748,888 | A * | 7/1973 | Gerich | 72/375 |
| 4,630,019 | A * | 12/1986 | Maier et al. | 337/70 |
| 4,682,141 | A * | 7/1987 | Hickling | 337/379 |
| 5,077,535 | A * | 12/1991 | Wehl | 337/373 |
| 5,317,471 | A * | 5/1994 | Izoard et al. | 361/105 |
| 5,781,097 | A * | 7/1998 | Givler | 337/367 |
| 5,877,670 | A * | 3/1999 | Sehlhorst et al. | 337/302 |
| 6,030,114 | A * | 2/2000 | DiMarco et al. | 374/1 |
| 6,104,273 | A * | 8/2000 | Larranaga et al. | 337/82 |
| 6,229,426 | B1 * | 5/2001 | Lavado et al. | 337/57 |
| 6,377,158 | B1 * | 4/2002 | Yu | 337/37 |
| 6,552,645 | B2 * | 4/2003 | Kuczynski | 337/111 |
| 6,580,351 | B2 * | 6/2003 | Davis et al. | 337/111 |
| 6,720,856 | B1 * | 4/2004 | Pellon et al. | 337/82 |
| 6,756,876 | B2 | 6/2004 | Sullivan et al. | |
| 6,762,668 | B2 * | 7/2004 | Davis et al. | 337/111 |
| 6,803,850 | B2 * | 10/2004 | Richter | 337/107 |
| 6,816,055 | B2 * | 11/2004 | Weber | 337/82 |
| 7,135,953 | B2 * | 11/2006 | Leitl et al. | 337/84 |
| 2003/0011461 | A1 * | 1/2003 | Yu | 337/89 |
| 2004/0070483 | A1 * | 4/2004 | Richter | 337/23 |

* cited by examiner

*Primary Examiner*—Anatoly Vortman
(74) *Attorney, Agent, or Firm*—Russell E. Baumann

(57) ABSTRACT

A thermally actuated device, such as an electrical circuit breaker (10) is provided with an ambient temperature compensation thermostat metal member (38) selected so that it bends when subjected to changes in temperature and compensates for ambient temperature effects on a thermostat metal trip arm for a selected current rating. Movement of such thermostat metal member is directly proportional to the flexivity of the material and to the square of the length of the member and indirectly proportional to the thickness of the member. Since packaging constraints make changes in length impractical, compensation members used to provide temperature compensation for different current ratings of the device typically have been made by using members of different thickness. In accordance with the invention, ambient temperature compensation members for a family of devices having a plurality of different current ratings is provided by changing the effective length of respective blank thermal compensation members by stamping selected deformations (48*c*, 50*c*) appropriate for each current rating in respective blank compensation members.

4 Claims, 3 Drawing Sheets

METHOD FOR AMBIENT TEMPERATURE COMPENSATING THERMOSTAT METAL ACTUATED ELECTRICAL DEVICES HAVING A PLURALITY OF CURRENT RATINGS

FIELD OF THE INVENTION

This invention relates generally to thermostat metal, such as bimetal, actuated devices and more specifically to a method for providing ambient temperature compensation for a series of devices having different current ratings.

BACKGROUND OF THE INVENTION

Presently, thermally compensated thermostat metal actuated electrical devices use a thermostat metal, such as bimetal, compensator to provide relatively constant levels of hold and trip currents as a function of ambient temperature. However, in providing suitable thermostat metal compensation for a series of devices having different current ratings the level of compensation must be changed appropriately. To provide for a range of compensation that may be needed as one goes from one ampere rating to the next, different thickness thermostat metals and different types metals for the thermostat metals are used to obtain varying levels of bimetal activity (movement per degree Fahrenheit). The formula for thermostat metal movement is shown below:

$$B(\text{thermostat metal movement})=0.53F(\Delta T)L^2/t$$

Where F is flexivity ($10^{-7}$/degree Fahrenheit), T is degrees Fahrenheit, thermostat metal movement B, length L and thickness t are in inches.

As noted above, it is known to use different thickness thermostat metals to obtain different levels of compensation, i.e., different amounts of movement per degree of temperature, for example 0.023, 0.026, 0.028, 0.030 inch thickness. However, this approach for changing compensation levels has several disadvantages. The first disadvantage is that this approach is relatively expensive to provide because manufacturing different thicknesses requires the use of heavy rolling mills and the like that produce large quantities of material while only small quantities are needed for each rating of compensation members thereby resulting in excessively large amounts of inventory. Further, the mass of the compensators and associated latches for higher ratings increase along with thickness making the circuit breakers more sensitive to shock and vibration.

Changing the length of the thermostat metal compensator is impractical because of packaging constrains. That is, designers of equipment with which the devices are to be used, such as aircraft, typically are not able to accommodate device packages of different sizes.

SUMMARY OF THE INVENTION

It is therefore, an object of the present invention to provide ambient temperature compensation for a series of thermostat metal actuated electrical devices that is not subject to the prior art limitations noted above.

Another object of the invention is the provision of a method for ambient temperature compensating electrical aircraft circuit breakers for a series of different current ratings that is relatively inexpensive while at the same time providing such breakers that are generally insensitive to vibration and shock resistance from one device rating to another.

Briefly, in accordance with the invention, the effective length of a thermostat metal compensator element is changed, while keeping the actual length unchanged, by forming various selected dimple or rib configurations in the element. Preferably, a compensator element is formed from thinner material than any of the presently used compensators and then ribbed to effectively reduce the active or effective length of the element without changing the overall length of the element. One compensator element thickness, e.g., 0.018 inch, with various dimple patterns can be used for an entire family of circuit breakers, or other thermostat metal actuated devices, providing the most active to the least active compensation by increasing the deformations in a controlled manner. Compensation elements used in accordance with the invention are less costly and provide improved shock and vibration resistance, particularly in higher current ratings that have the trip latch attached to the compensator element, since the trip latch for higher current rating breakers made in accordance with the invention will have less mass than circuit breakers with conventional thicker compensator elements. Thus, in combination with lower friction latches, lower actuation forces are utilized thereby minimizing concerns of shock and vibration issues. Another advantage is that this approach also allows the use of low force piezo-resistive actuators to work more effectively with associated latches in arc fault or similar applications.

Other objects, features and advantages of the present invention will appear from the following detailed description of a preferred embodiment taken together with the accompanying drawings.

DETAILED DESCRIPTION OF THE PREFERRED EMBODIMENT

Figure 1:
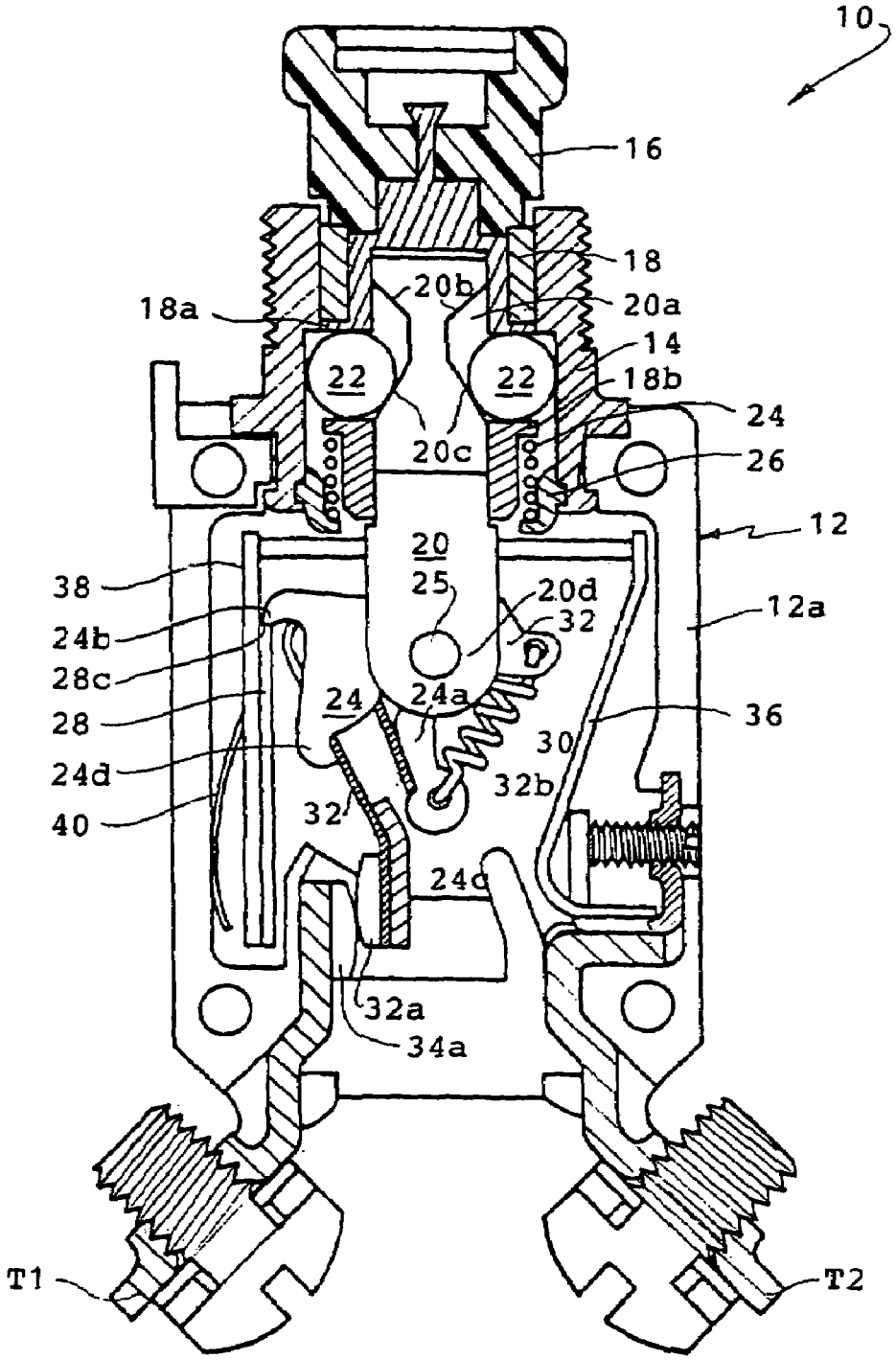
PRIOR ART Fig. 1
FIG. 1 is a cross-sectional, elevational view of a prior art aircraft circuit breaker, with the front portion of the housing removed for purposes of illustration.
Figure 2:
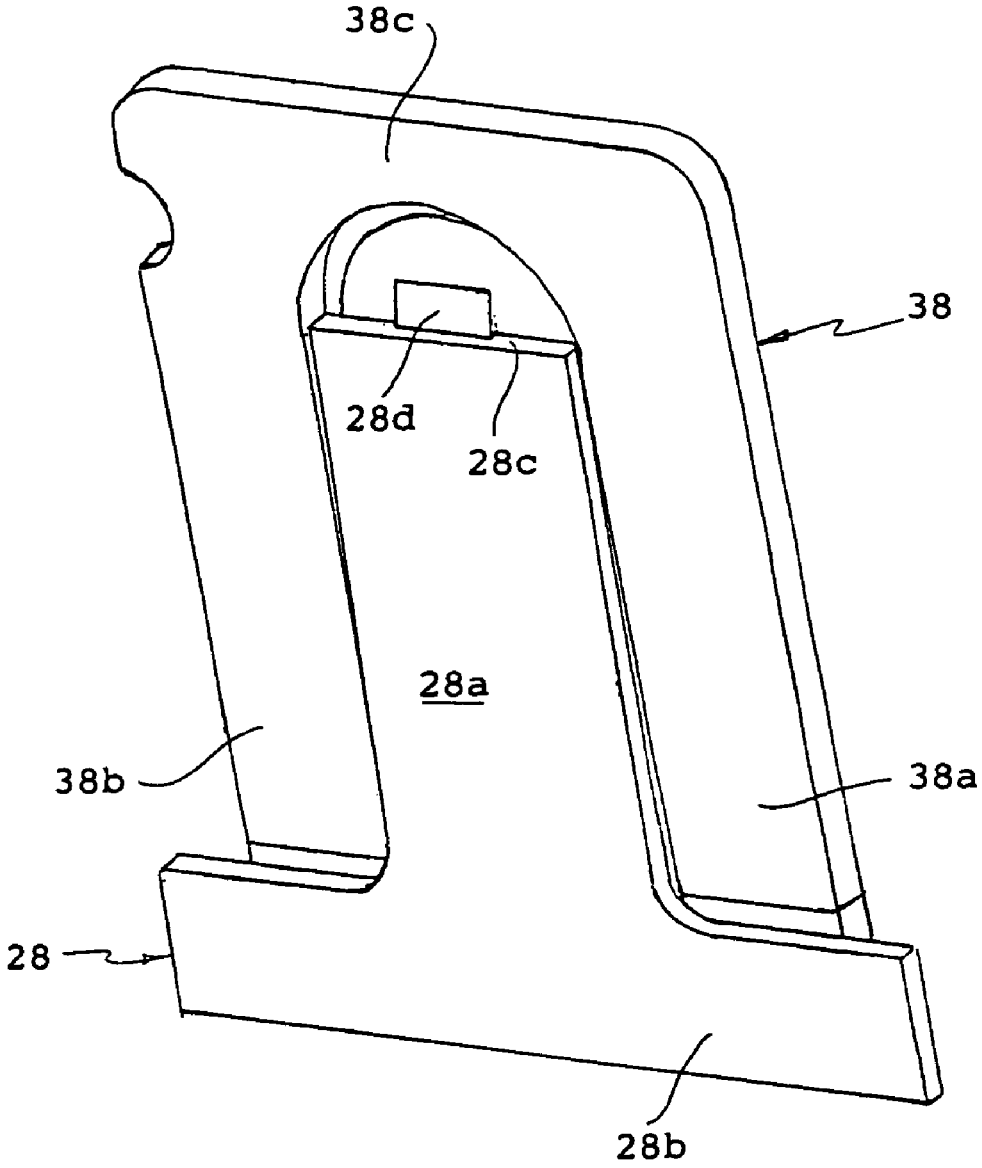
PRIOR ART Fig. 2
FIG. 2 is a perspective view of a thermostat metal ambient compensation element and catch member assembly used in the FIG. 1 circuit breaker.

With reference to FIGS. 1 and 2, an aircraft type circuit breaker 10 made in accordance with the prior art comprises a housing 12 having a case half 12A, shown, and a matching case half removed for the purpose of illustration. A bushing 14 is mounted in the housing that in turn mounts a push button 16 slidably movable within the bore of bushing 14 between an open contacts position (not shown) and a closed contacts position shown in the Figure. Push button 16 is fixed to sleeve 18 that slidably mounts in its bore a latch plunger 20. Latch plunger 20 is formed with an annular recess 20*a* around the periphery thereof having oppositely tapered surfaces 20*b*, 20*c* respectively, that cooperate with diametrically opposed openings 18*a* in sleeve 18 and latch balls 22 received in openings 18*a*. Sleeve 18 is formed with an outwardly extending radial flange 18*b* that serve as a compression spring seat. A push button return compression spring 24 is seated between seat 18*b* and an oppositely disposed spring seat formed in annular element 26 fixedly mounted at the inner end of bushing 14.

The inner end of latch plunger 20 is formed into a yoke for pivotably mounting a bell crank latch 24 on pin 25 extending between the opposed legs 20*d* of the yoke (one leg being shown in FIG. 1). Pin 25 extends beyond the yoke in both opposite directions for receipt in vertically extending guide channels (not shown) formed in the walls of the case halves.

Bell crank latch 24 is formed with a latch part 24*b* adapted to be received on a catch surface 28*c* of catch member 28, to be discussed. Bell rank latch 24 also has a downwardly extending leg 24*a* formed with an aperture 24*c* that serves as a connection location for a coil spring 30 also connected to anchor plate 32. Anchor plate 32 is fixedly mounted relative to latch plunger 20 so that a bias is applied to bell crank latch 24 urging it in a counter clockwise direction, as viewed in FIG. 1.

A leaf spring bent back on itself serves as a movable contact arm 32 and carries bridging movable contacts 32*a*. Arm 32 has one end 32*b* mounted in a notch in leg 24*a* of bell crank latch 24 while hook 24*d* of the latch engages an outer face of movable arm 32 on the opposite side of the bend limiting movement of the arm and serving as a motion transfer member in opening of the contacts when catch surface 28*c* moves out of engagement with latch part 24*b*.

First and second, spaced apart and electrically separated stationary electrical contacts 34*a* (one being shown) are mounted in the housing with terminal T1 mounting one stationary contact 34*a* and the other stationary contact being electrically connected by a pig tail connector (not shown), or the like, to one leg of current carrying, generally U-shaped thermostat metal trip arm 36. The other leg of trip arm 36 is mounted on and electrically connected to terminal T2 so that current passes through T2, thermostat metal trip arm 36 to the stationary contact hidden behind contact 34*a* shown in FIG. 1 by the pig tail connector, or the like, bridging contact 32*a*, the other stationary contact 34*a* and finally terminal T1.

As best seen in FIG. 2, catch member 28 is an inverted, generally T-shaped member formed of suitable material, such as steel, with the horizontal bar portion 28*b* of the T-shaped member serving as a base and the center, vertical portion 28*a* having a distal free end with edge 28*c* thereof serving as the catch surface, as mentioned above. A thermostat metal ambient compensation member 38, generally U-shaped having first and second legs 38*a*, 38*b*, respectively, extending from a bight portion 38*c* has the distal ends of the U-shaped member fixedly attached to base 28*b* of the catch member, as by welding. This assembly is pivotably mounted at its base in a groove formed in the housing and a spring 40 (FIG. 1) is disposed between the catch member 28 and the side wall of the housing that exerts a clockwise bias on the assembly.

A horizontally slidable motion transfer member 42 is disposed between the bight or upper ends of thermostat metal trip arm 36 and thermostat metal ambient compensation member 38 to transfer motion from trip member 36 to the compensation/catch assembly.

Trip arm 36 reacts both to ambient temperature and to the heat generated by current passing through the arm and upon heating, the upper portion of the trip arm will bend to the left, as seen in FIG. 1. In order to compensate for ambient temperatures changes, thermostat metal ambient temperature compensation member 38 is formed so that it will react to ambient temperature changes essentially the same as trip arm 36 so that a change in ambient temperature will cause both trip arm 36 and compensator member 38 to bend in the same direction essentially the same amount with the result that the position of the catch surface of the compensator member/trip arm member assembly will remain unchanged. Upon a selected temperature increase caused by over current conditions, trip member 36 will bend more than the compensation member 38 and this motion will be transferred by motion transfer member 42 to thereby pivot the compensation/catch member assembly counter clockwise to move catch surface 28*c* away from the latch part 24*b*. This results in opening of the electrical contacts and unlatching the ball latch of the push button.

For a more detailed description of the operation of the circuit breaker, reference may be had to U.S. Pat. No. 3,361,882, issued Oct. 24, 1965 to the assignee of the present invention which shows and describes this type of aircraft circuit breaker.

As noted above, thermostat metal movement can be determined by the following formula:

$$B(\text{thermostat metal movement})=0.53F(\Delta T)L^2/t \text{ where}$$

F is flexivity ($10^{-7}$/degree Fahrenheit); T is degrees Fahrenheit; thermostat metal movement B, length L and thickness t are in inches.

As discussed above, the present practice in providing ambient compensation is to change the thickness of the thermostat metal used for the ambient compensation member in order to match the thermostat metal movement of the trip arm at different current ratings due to the impracticality of changing the other variables in the formula. However, in accordance with the present invention, the effective length of the thermostat metal member is changed through the use of metal deformations such as grooves, dimples or the like. A compensator member is formed from the thinnest thermostat metal used in the existing compensators presently used or, if desired, thinner than any presently used, forming controlled ribs to effectively reduce the effective length and thereby make the member less active. Thus, one basic temperature compensator thickness, e.g., 0.018 inch thick, can be modified with various dimple patterns for use in an entire family of circuit breakers providing compensators ranging from the most active (with relatively few, if any, deformations) to the least active with the greatest amount of deformations. Compensators made in accordance with the invention have the additional advantage of being lighter in weight (along with lighter associated latches), as well as being less costly and provide significantly improved shock and vibration resistance in ambient compensated devices in which the compensation members are attached to the trip latch. In combination with low friction latches, lower actuation forces are needed (without fear of shock and vibration issues) for use with low force piezoresistive actuators to work more effectively with the latches in arc fault or similar application.

Figure 3:
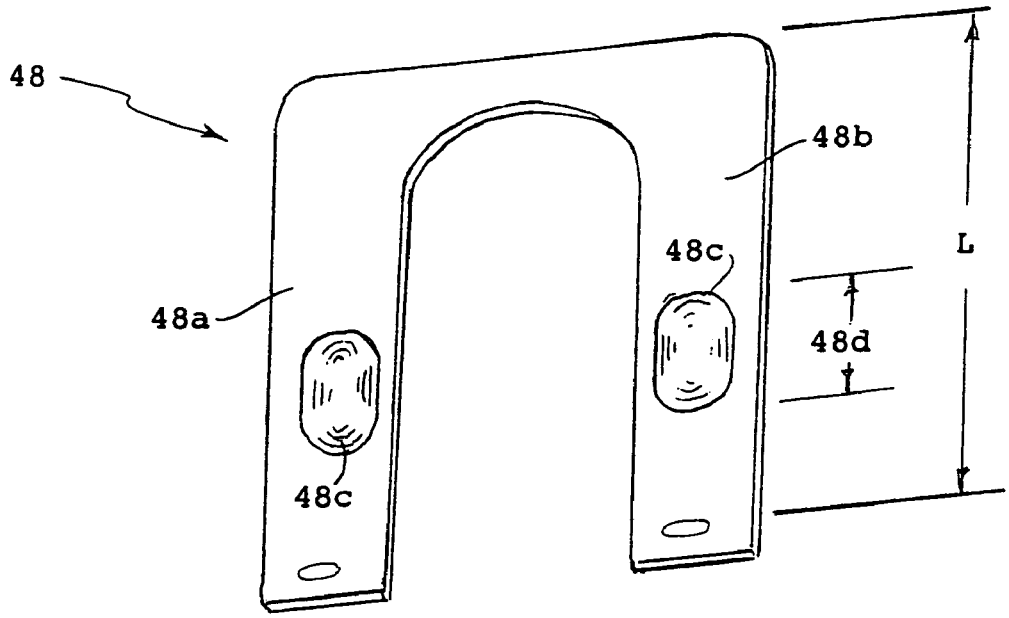
FIGS. 3 and 4 are perspective views of two thermostat metal ambient compensator elements having different effective lengths provided by respective due to selected ribbed deformations in the elements.
Figure 4:
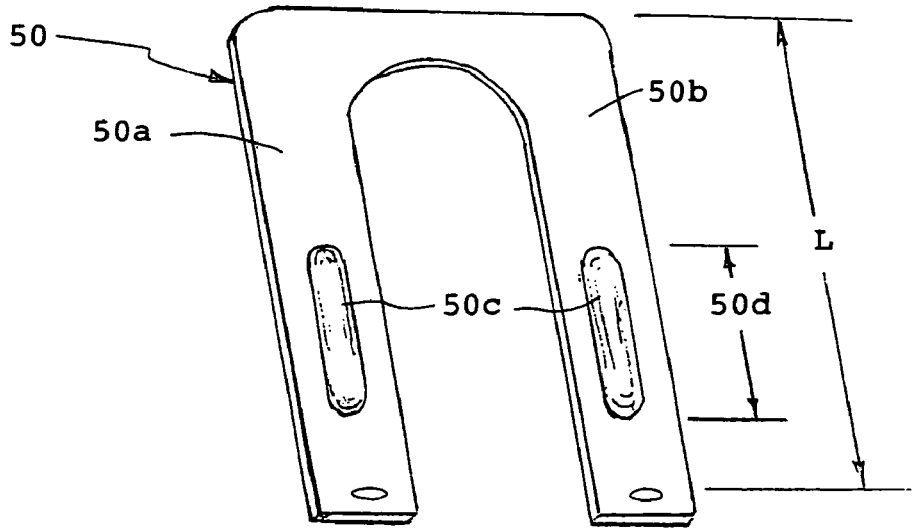

Thus, with reference to FIG. 3, compensation member 48, a generally U-shaped member having legs 48*a*, 48*b*, has an actual length L and is formed with a deformation pattern comprising a rib shape 48*c* having a first length 48*d* and of a selected depth and width in each leg to reduce the effective length of the member with respect to thermostat metal movement, as defined in the above referenced formula. With regard to FIG. 4, compensation member 50, the same as that shown in FIG. 3 with legs 50*a*, 50*b* of the same thickness and actual length L as member 48, is formed with a deformation pattern comprising a rib 50*c* having a second length 50*d* and of a selected depth and width in each leg somewhat longer and slightly narrower than ribs 48*c* to reduce the effective length of member 50 even more than that of member 48.

The depth, width and the length of the deformations each has an affect on the effective length so that tooling for the deformations needs to be tailored to obtain desired specific thermostat metal movement for given current ratings.

Although the invention has been described for use in a circuit breaker, it will be appreciated that the invention can be applied to any device that utilizes an ambient temperature compensation member.

It should be understood that although a particular preferred embodiment has been described by way of illustrating the invention, other embodiments are possible. It is intended that the invention includes all modifications and equivalents of the disclosed embodiment that fits within the scope of the claims.

What is claimed:

1. In an ambient compensated circuit breaker having an opening and closing mechanism for moving a movable electrical contact into and out of electrical engagement with a stationary electrical contact including a trip latch and a catch surface engageable with the trip latch for maintaining the opening and closing mechanism in the engaged contacts position during normal operation, an ambient thermostat metal compensation member coupled to the catch surface, a current carrying thermostat metal trip arm which bends upon being heated, the bending movement transferred to the ambient thermostat metal compensation member, the ambient thermostat metal compensation member bending in the same direction as the trip arm upon changes in ambient temperature to maintain a generally constant relative position of the trip latch and catch surface in response to such ambient temperature changes, motion from the trip arm upon selected overload current transferred to the catch surface through the ambient thermostat metal compensation member thereby separating the catch surface from the trip latch allowing the opening and closing mechanism to move the movable contact out of engagement with the stationary contact, the ambient thermostat compensation member having a selected thickness and length, movement of the ambient thermostat metal compensation being subject to the following formula:

$$B(\text{thermostat metal movement})=0.53F(\Delta T)L^2/t \text{ where}$$

F is flexivity ($10^{-7}$/degree Fahrenheit), L is length (inches), T is temperature (degrees Fahrenheit) and t is thickness (inches), the method comprising the steps of changing the level of thermal compensation of the ambient temperature thermostat metal compensation member by choosing a single selected thickness and actual length for a series of different thermal compensation levels and changing the effective length of the ambient temperature thermostat metal compensation member by form in ribs into a selected size in the ambient temperature compensation member wherein the greater the size of the ribs, the less the movement.

2. In a thermally responsive switch having a current carrying thermostat metal actuator member of a first selected thickness and length suitable for a first selected current rating mounted in a housing, a portion of the actuator member being movable in dependence upon changes in temperature, a non-current carrying ambient temperature thermostat metal compensation member mounted in the housing and having a portion movable in the same direction as the actuator member portion in response to ambient temperature changes to maintain a generally constant distance between the two said portions, a switching member coupled to the said portions so that a selected change in the distance between the two said portions will cause the switching member to actuate the switch, a member for modifying the ambient compensation member for use for other selected high current ratings comprising the steps of taking an ambient temperature thermostat metal compensation member having a given length and a given thickness, modifying the ambient compensation member to make it suitable for use in a second, higher current rating switch having a current carrying thermostat metal actuator by reducing the effective length of the ambient compensation member without changing the actual length thereof.

3. A method according to claim 2 in which reducing in the effective length of the ambient compensation member is effected by placing a selected deformation pattern in the ambient temperature compensation member.

4. In a thermally actuated electrical device having a movable electrical contact movable into and out of engagement with a stationary electrical contact and having a contact opening and closing mechanism, and a current carrying thermostat metal element, the method comprising the steps of:

choosing a blank starting thermostat metal ambient temperature compensation member having a selected flexivity, thickness and actual length, movement of the thermostat metal compensation member being subject to the following formula:

$$B(\text{thermostat metal movement})=0.53F(\Delta T)L^2/t \text{ where}$$

F is flexivity ($10^{-7}$/degree Fahrenheit), L is length in inches, T is temperature in degrees Fahrenheit, t is thickness in inches and B is in inches, changing the level of ambient compensation of the blank thermostat metal member by forming a selected pattern of deformations in the member thereby changing the effective length thereof wherein the greater the size of the selected pattern of the deformations, the less the effective length.

* * * * *